US007003903B2

(12) United States Patent
Johnson

(10) Patent No.: US 7,003,903 B2
(45) Date of Patent: Feb. 28, 2006

(54) POUCH FOR CONCEALING AND CONTAINING SHOELACES

(76) Inventor: Jay Allen Johnson, P.O. Box 1247, Powell, TN (US) 37849

( * ) Notice: Subject to any disclaimer, the term of this patent is extended or adjusted under 35 U.S.C. 154(b) by 0 days.

(21) Appl. No.: 10/370,215

(22) Filed: Feb. 21, 2003

(65) Prior Publication Data

US 2004/0163285 A1 Aug. 26, 2004

(51) Int. Cl.

| | |
|---|---|
| ***A43B 23/00*** | (2006.01) |
| ***A43C 11/00*** | (2006.01) |
| ***A43C 5/00*** | (2006.01) |
| ***A43C 7/00*** | (2006.01) |
| ***A43C 7/04*** | (2006.01) |

(52) U.S. Cl. ..... 36/136; 36/50.1; 24/712.1; 24/712.6; 24/713.6

(58) Field of Classification Search ..... 36/136, 36/50.1, 54; 24/712.3, 712.1, 712.6, 713.6, 24/442

See application file for complete search history.

(56) References Cited

U.S. PATENT DOCUMENTS

| | | | | |
|---|---|---|---|---|
| 1,371,637 | A * | 3/1921 | Meredith | 24/712.3 |
| 2,674,021 | A * | 4/1954 | Cataldi | 24/712.3 |
| 3,106,003 | A * | 10/1963 | Herdman | 24/712.3 |
| 3,132,394 | A * | 5/1964 | Russell | 24/712.3 |
| 3,473,198 | A * | 10/1969 | Meier | 24/712.3 |
| 4,999,888 | A * | 3/1991 | Miller | 24/712.3 |
| 5,918,352 | A * | 7/1999 | Galbreath | 24/712.3 |
| 6,000,111 | A * | 12/1999 | Deskins et al. | 24/712.3 |
| 6,457,266 | B1 * | 10/2002 | Hsiao | 36/50.1 |
| 6,473,999 | B1 * | 11/2002 | Fellouhe | 36/50.1 |
| 6,601,323 | B1 * | 8/2003 | Tsujino et al. | 36/136 |
| 2001/0025434 | A1 * | 10/2001 | Fellouhe | 36/50.1 |

FOREIGN PATENT DOCUMENTS

| | | | |
|---|---|---|---|
| GB | 2224426 | * | 5/1990 |

* cited by examiner

*Primary Examiner*—Anthony Stashick
(74) *Attorney, Agent, or Firm*—Luedeka, Neely and Graham, P.C.

(57) ABSTRACT

A shoe with improved lacing means includes a shoe, shoe laces (14) and a hook and loop element pouch (10). On the underside, the side making contact with the shoe, are two openings (16) that are used to slide the shoelaces through. With the pouch (10) open, the shoelaces (14) are pushed through the holes (16), pulled firmly and then tied as usual. Place the tied shoelaces (14) down into the pouch (10). There is a hook and loop element strip (22) on the opening making it easy to close, while keeping laces (14) secure. The pouch (10) can be attached to the shoe by hook and loop element strips (18) on both the right and left underside of the pouch (10). The pouch (10) will keep the shoelaces (14) from loosening, snagging and untying.

16 Claims, 4 Drawing Sheets

POUCH FOR CONCEALING AND CONTAINING SHOELACES

CROSS-REFERENCE TO RELATED APPLICATIONS

Not applicable.

BACKGROUND

1. Field of Invention

This invention relates to shoes, specifically to an improved securement, concealment and fastening device for shoes with laces.

2. Description for Prior Art

Originally laces on shoes were designed to tie leaving laces to hang. This greatly increased the possibility for snagging on foreign objects and tripping. This problem has been partially solved by the implementation of lace securing devices, but these had and still have significant problems for the highly active foot activities (for example bicycling, baseball, football, basketball, and running).

Thereafter, inventors created several types of shoelace devices to secure laces tight and/or conceal laces. U.S. Pat. No. 4,884,321 (1989), U.S. Pat. No. 4,879,787 (1989), U.S. Pat. No. 6,260,246 (2001) and U.S. Pat. No. 5,913,483 (1999) disclose similar ways to help aid in keeping laces fastened while tied. These patents use a device that when the laces are tied in a traditional way is to be secured at the knot leaving lace loops to hang. These devices while successfully aid in the fastening of laces still do not offer security or concealment, which is important to today's increased level of sports activity.

Thus, if the shoelaces are fastened with the above listed patents (U.S. Pat. Nos. 4,884,321, 4,879,787, 6,260,246, and 5,913,483) they would leave laces free to dangle, which will greatly increase the possibility of snagging or catching on objects. Also, having the device secured at the knot it cannot be easily retied in the quick fashion needed for a fast paced sporting environment.

U.S. Pat. No. 5,170,573 (1992) discloses that it provides securement, fastening and concealment by an open material that is to be folded together and attached to make a tight pouch. This device takes too much time to close into a neat pouch when the need for retying occurs. Also, the pouch only secures to the shoe by the laces passing through the opening in the device and then being tied, leaving the pouch free for movement. This device is left to move about on the shoe, which in high foot activity comprises comfort. Also, if the above device is used the problem of retying occur as with the patents U.S. Pat. Nos. 4,884,321, 4,879,787, 6,260,246 and 5,913,483.

U.S. Pat. No. 5,778,500 (1998) discloses ways to secure, fasten and conceal laces by using a flexible material covered by hook elements on one half and loop elements on the other half. After tying the shoelaces, the sides are brought together to consume the laces with the hook and loop elements. To retighten the laces the top half of the hook and loop device is to be lifted from the opposite side, causing pulling of the laces and possible untying, making retightening difficult and inefficient in the sports environment.

U.S. Pat. No. 6,000,111 (1999) discloses a folding material with hook and loop elements around the perimeter that when closed makes a tight and flat device. Also being a flat device this patent needs to be attached by two openings on the bottom of the device laced at separate sections of the shoe. This causes a problem in sporting footwear in two important areas, a) because the device is flat it makes it difficult to be used on mid-top, ¾ and high-top shoes, due to the bend of the shoe at the top ankle. The flat device has to cover a larger area to accommodate the laces. This being a high stress area will cause hook and loop elements to wear rapidly. B) The above patents needs to be attached in two separate locations making it impossible to quickly attach and remove.

U.S. Pat. No. 4,766,682 (1988) discloses a removable lace cover strap that wraps from where laces are located, around the arch of the shoe, and then back to the lace tying location. Although achieving security, fastening and concealment, this device is too bulky and covers part of the soul of the shoe, comprising the design of the shoe for traction.

SUMMARY

In accordance with the present invention a shoelace securement and concealment device comprises a pouch having an opening with hook and loop elements, optional hook and loop elements on the bottom right and left underside and openings on the underside to pull laces up through the pouch. The top opening with hook and loop elements provide easy access to laces and the optional hook and loop elements on the bottom right and left underside provides securement of the pouch to the shoe.

OBJECTS AND ADVANTAGES

Accordingly, several objects and advantages of my invention are:

(a) to provide a lightweight securement and concealment pouch for highly active foot activities that can be opened and closed quickly.

(b) to provide a lightweight securement and concealment pouch for highly active foot activities that can be secured to the shoe.

(c) to provide a lightweight securement and concealment pouch that will not shake or bounce while secured to the shoe but move as one with the shoe.

(d) to provide a lightweight securement and concealment pouch which will conceal the laces in the pouch to greatly reduce the risk of snagging on foreign objects and tripping.

(e) to provide a lightweight securment and concealment pouch which will secure the laces in the pouch to greatly reduce untying.

(f) to provide a lightweight securment and concealment pouch which will keep laces from flopping continuously during high foot activities.

(g) to provide a lightweight securment and concealment pouch which will give the user a possible sense of confidence while under high activity.

(h) to provide a lightweight securement and concealment pouch which can be moved from one pair of shoes to another pair easily.

Further objects and advantages of my invention will become apparent from a consideration for the drawings and ensuing description.

DRAWING FIGURES

In the drawings, closely related figures have the same number but different alphabetic suffixes.

Figure 3A:
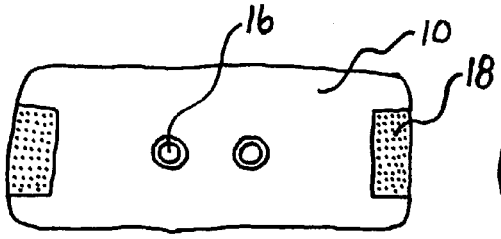
Figure 3B:
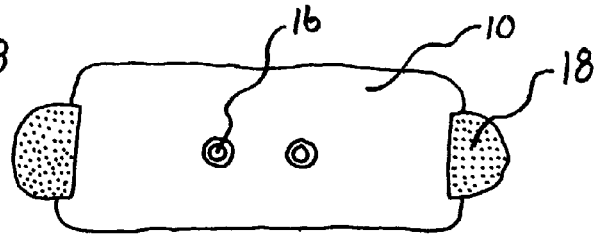

FIGS. 3*a* and 3*b* shows the bottom view closed pouch showing the opening for laces and the optional hook and loop possibilities.

Figure 4A:
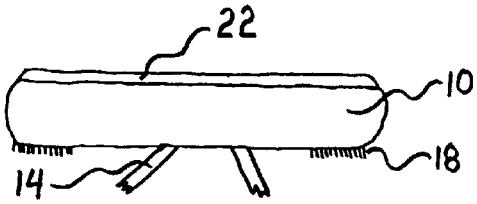
Figure 4B:
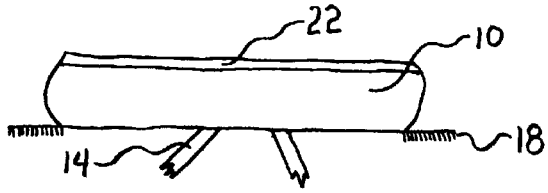

FIGS. 4*a* and 4*b* shows the front view closed pouch showing top hook and loop closure strip and bottom hook and loop possibilities.

Figure 5A:
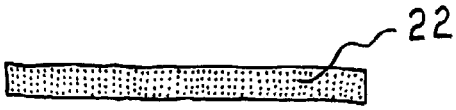
Figure 5B:
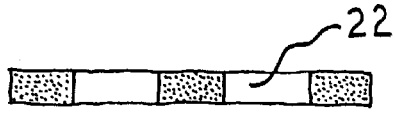

FIGS. 5*a* and 5*b* shows hook and loop closure strip with the optional possibilities.

Figure 6:
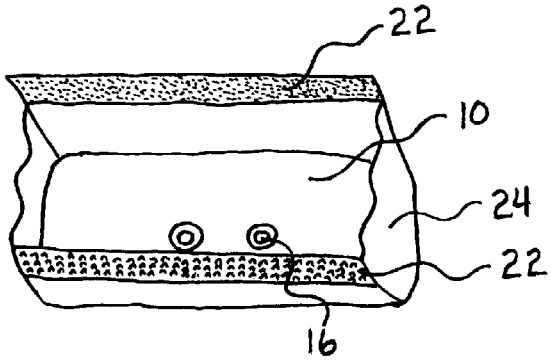

FIG. 6 shows the top angle view without laces and an open pouch without the optional bottom hook and loop elements.

Figure 7:
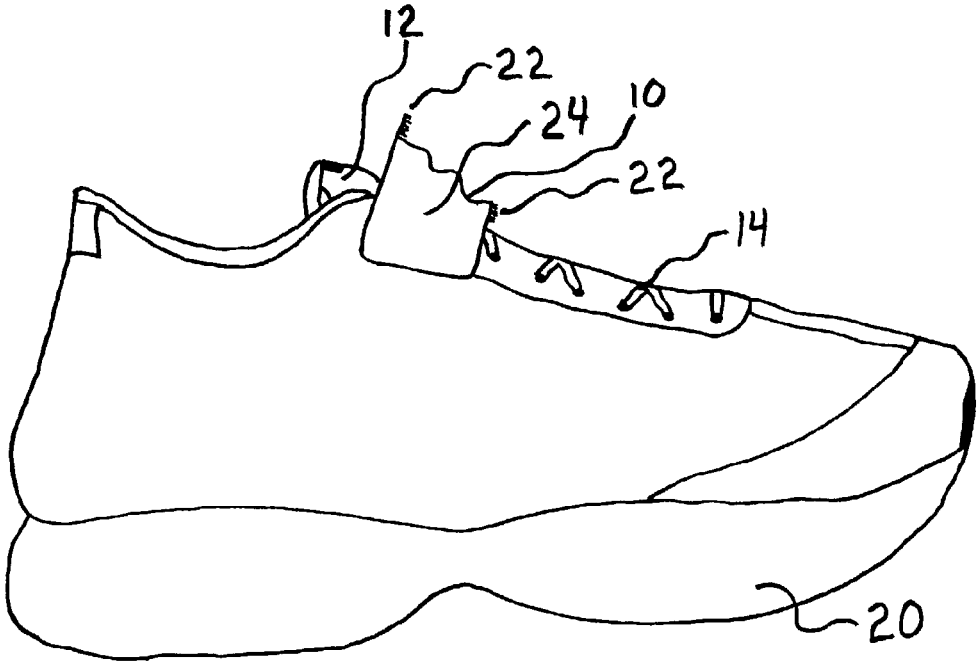

FIG. 7 shows the side view with the pouch open to view the side options for flexibility (shown without the optional bottom hook and loop elements).

REFERENCE NUMERALS IN DRAWINGS

Figure 1:
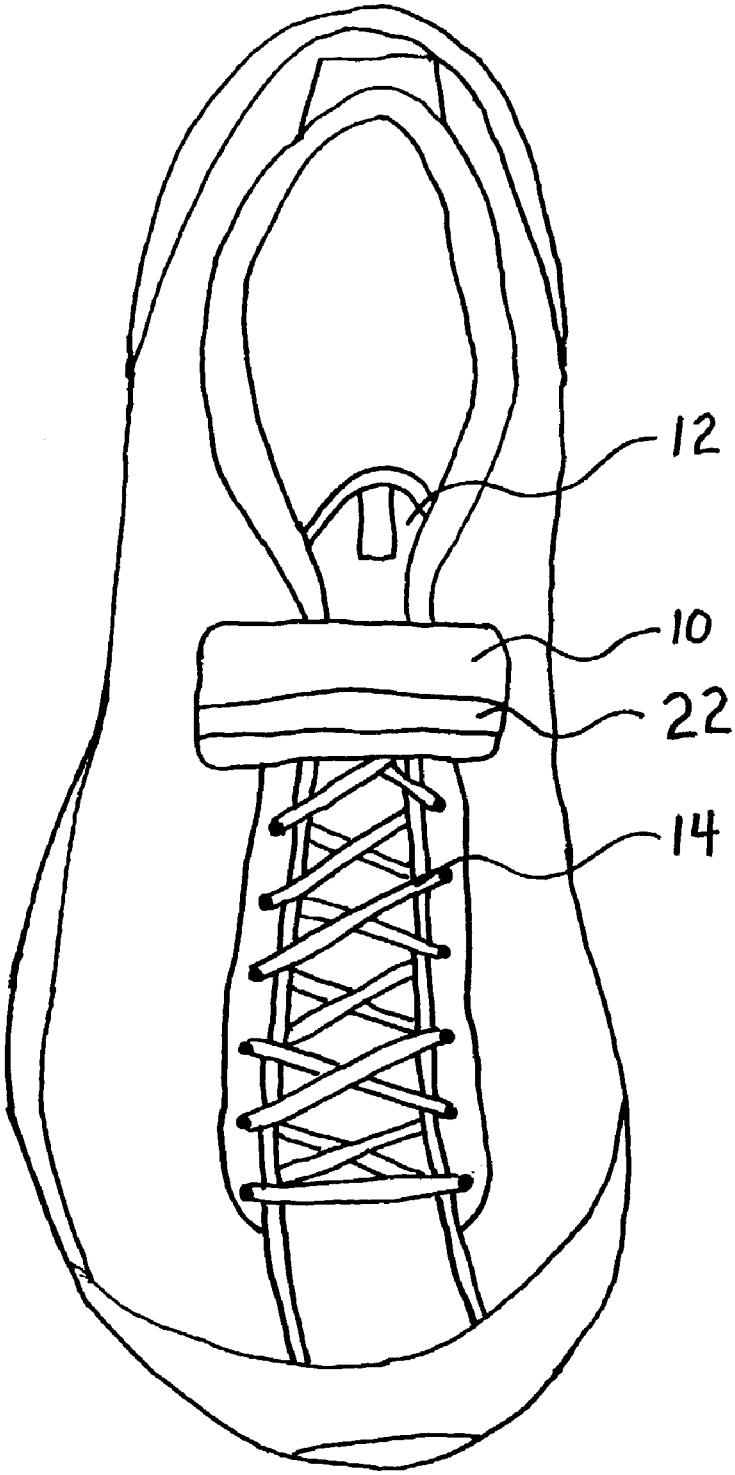
FIG. 1 shows a top view of the pouch closed, without the optional bottom hook and loop elements.
Figure 2:
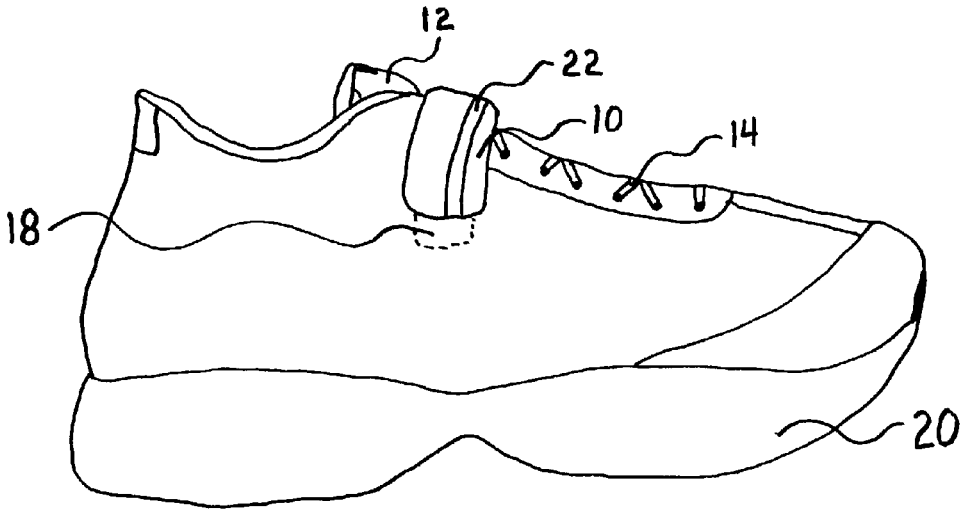
FIG. 2 shows a side view of the pouch closed with the optional bottom hook and loop elements.

10 pouch
12 tongue of shoe
14 shoelaces
16 opening for laces
18 optional bottom hook and loop element strips
20 shoe sole
22 hook and loop closure strip
24 side material Description—FIGS. 1 and 2 Preferred Embodiment A preferred embodiment of the closure of the present invention is illustrated in FIG. 1 (top view) and FIG. 2 (side view). FIG. 1 shows the pouch 10 in place and closed on a shoe. The shoelaces 14 are secured inside the pouch 10 on top of the tongue 12. FIG. 1 shows the pouch 10 without the optional hook and loop element strips 18. FIG. 2 also shows the pouch 10 closed in place on a shoe. FIG. 2 shows the optional hook and loop element strips 18. The strips 18 are shown in hook and loop elements but any reusable closure system may be used. The strips 18 may also be in any shape. The strips 18 are used to secure the pouch 10 to the shoe during extreme foot activity.

At the top of the pouch 10 the closure 22 is secured (or closed). The strip 22 may be in a number of lengths or combinations (covered in FIGS. 5*a* and 5*b*). As with the optional bottom hook and loop element strips 18, an optional reusable closure system may be used. The smooth lightweight pouch 10 leaves the possibility for logo on top of the pouch 10 to bring together function and style. The pouch 10 also can be made with a number of materials. The ideal material would be flexible, lightweight and durable, such as a nylon blend.

The width of the pouch 10 (from view FIG. 1 from left to right) can be many widths but the ideal would be just outside the shoelace holes. This leaves an area for the optional bottom hook and loop element strips 18 to be used. The height of the pouch 10 (from view FIG. 1 from top to bottom of the pouch 10) can also be many heights but the ideal would be short enough just for the tied laces. This will keep the shoe weight as light as possible.

FIGS. 3A and 3B Additional Embodiments

Additional embodiments are shown in FIGS. 3*a* and 3*b* in each case the bottom view of a closed pouch 10 is used. This shows the openings 16 for the laces to enter the pouch 10. Hole openings 16 are shown as an example in FIGS. 3*a* and 3*b* but any opening will work as long as laces can pull through. These views also show the optional bottom hook and loop element strips 18. These as stated earlier, can be any material as long as it is reusable and closure is maintained. These strips 18 can be in any shape or location on the ends of the pouch 10 (FIGS. 3*a* and 3*b* are examples of this).

FIGS. 4A to 5B Alternative Embodiments

There are various possibilities with regard to the related closure systems 22 (the bottom optional hook and loop element strips discussed above). The hook and loop element closure strips 22 in FIGS. 5*a* and 5*b* show examples of hook and loop elements being used in two different examples: 5*a* is solid across the length of the pouch 10 opening, and 5*b* is sectioned. There are endless length and combinations that can be used. FIGS. 4*a* and 4*b* shows the front view of the pouch 10 closed with optional bottom hook and loop element strips 18. FIGS. 4*a* and 4*b* shows the ideal location for the optional hook and loop element strips 18 (other options discussed above).

FIGS. 6 and 7 Additional Embodiments

Additional embodiments are shown in FIG. 6 and FIG. 7 in each case the pouch 10 is opened. FIG. 6 is a top angle view without laces 14 and open pouch 10. The opening for laces 16 is seen as would appear empty. The laces 14 will be concealed in this area. The hook and loop element strip 22 is shown as a solid. The side material 24 can be the same as the rest of the pouch 10 or other more flexible material may be used. This side material 24 is designed to fold so when the pouch 10 is closed, the side material 24 is worked inward towards the opening for laces 16 (or towards the middle of the pouch 10). FIG. 7 is a side view with the pouch 10 open to view side options for flexibility. FIG. 7 shows the same benefits as FIG. 6 but at a different angle.

Advantages

From the description above, a number of advantages of my pouch become evident:

a) Many athletic events cause the need to have quick footwork by the athlete. When this need arises and the shoes are close together, the pouch with the shoelaces concealed will keep the athlete from tripping on ones own laces. In cleated shoe sports the risk of tripping is greater (example: football, baseball, and soccer) because the sole of the shoes have petrusions.

b) The pouch conceals the laces so the laces will not get caught or hung on outside objects (example: bicycle gears and other player's feet).

c) The pouch system secures normally tied laces so that untying becomes very difficult from constant pounding or above mentioned examples.

d) The pouch system with bottom hook and loop element strips keep laces from flopping around and the bottom hook and loop element strips keep the pouch against the shoe securely.

e) The pouch can easily be moved from one pair of shoes to another, simply by opening, untying the laces and pulling the laces out of the pouch. The shoes do not need to be tied in a new manner. The traditional tying is sufficient.

f) The securement and concealment of the pouch can give an athlete a sense of peace of mind.

Operation FIG. 1, 2, 3A, 6, 7

The manner of using the pouch 10 on the shoe to secure and conceal laces is as follows: (in FIG. 1) Taking any shoe laced in the traditional way but not tied, the loose laces are fed into the openings 16 (FIG. 3*a*) on the bottom of the pouch 10, then pulled through firmly and tied regularly. The pouch 10 in FIG. 7 only needs to be closed by pressing the hook and loop elements at the opening together as shown in FIG. 6, 7 and closed view in FIG. 1.

To retie, tighten laces or remove the pouch 10, one pulls open the hook and loop element closure strip 22, opening the pouch 10. To retie or tighten laces 14 simply pull laces 14 out of the opening and retie or tighten. To remove the pouch 10 untie laces 14 and pull the pouch 10 up feeding laces 14 through the openings 16.

The pouch can be used to secure or conceal the same laces or moved to other shoes many times; one simply follows the above steps.

FIGS. 1 and 2 shows a top and side view of a closed pouch 10, FIG. 7 shows the pouch 10 in place and opened.

CONCLUSION, RAMIFICATIONS, AND SCOPE

Accordingly, the reader will see that the pouch of this invention can be used to secure and conceal laces easily and conveniently. The pouch can be removed and used on other shoes easily, simply open and pull laces out of the pouch. The laces being secure and concealed will greatly reduce the risk of snagging on outside obstacles or loosening in high foot activity. The pouch can also give the user a sense of confidence while under high foot activity. Furthermore, the pouch has the additional advantages in that

- It permits the production of the pouch without requiring the shoe company to change shoe production. The pouch can be used with any shoe that has laces.
- It permits the pouch to be made in many different sizes and still work with the same principles.
- It permits the pouch to be made of many different materials.
- It permits the pouch to be made in any color.
- It provides a pouch with a superior surface upon which one can label or print.
- It permits the pouch to be made at different locations and added to shoes at a later time.

Although the description above contains many specifications, these should not be construed as limiting the scope of the invention but as merely providing illustrations of some of the presently preferred embodiments of this invention. For example, the different closure strip lengths and combinations and the optional bottom hook and loop elements that can be many different shapes and/or sizes.

Thus, the scope of the invention should be determined by the appended claims and their legal equivalents, rather than by the examples given.

I claim:

1. A shoelace knot containment poach for securely containing a knotted portion of shoelaces adjacent to a top portion of a tongue of a shoe, the shoelace containment pouch comprising:

a bottom portion containing a pair of openings therein;

inwardly foldable end portions attached to the bottom portion;

first and second side portions attached to the end portions and bottom portion, wherein the first side portion has a first flap and the second side portion has a second flap for at least partially overlapping the first flap; and a closure device removably engaging the first flap with the second flap for securely containing the knotted portion of the shoelaces within the pouch.

2. The shoelace knot containment pouch of claim 1, wherein each of the bottom portion, the side portions, the end portions, the first flap and the second flap comprise a material selected from the group consisting of cloth, leather, plastic, vinyl, and nylon.

3. The shoelace knot containment pouch of claim 1, wherein the material comprises nylon.

4. The shoelace knot containment pouch of claim 1, wherein the closure device comprises hook material attached to the first flap and loop material attached to the second flap.

5. The shoelace knot containment pouch of claim 1, wherein the closure device comprises loop material attached to the first flap and hook material attached to the second flap.

6. The shoelace knot containment pouch of claim 1, wherein the pouch is removably attached adjacent to the top portion of the tongue of the shoe.

7. The shoelace knot containment pouch of claim 6, wherein a hook and loop fastener is used to removably attach the pouch adjacent to the top portion of the tongue of the shoe.

8. The shoelace knot containment pouch of claim 1, further comprising hook material attached to the bottom portion adjacent to the end portions of the pouch outside of the pouch for removably attaching the pouch to loop material attached tote shoe adjacent tote top portion of the tongue of the shoe.

9. The shoelace knot containment pouch of claim 1, further comprising loop material attached to the bottom portion adjacent to the end portions of the pouch outside of the pouch for removably attaching the pouch to hook material attached to the shoe adjacent to the top portion of the tongue of the shoe.

10. The shoelace knot containment pouch of claim 1, wherein the bottom portion of the pouch is fixedly attached adjacent to the top portion of the tongue of the shoe using an attachment mechanism selected from the group consisting of an adhesive, an epoxy, and sewing.

11. A method for securely containing a shoelace knot adjacent to a top portion of a tongue of a shoe, the method comprising:

providing a shoelace knot containment pouch, the pouch including a bottom portion having a pair of openings therein, inwardly foldable end portions attached to the bottom portion, first and second side portions attached to the end portions and bottom portion, wherein the first side portion has a first flap and the second side portion has a second flap for at least partially overlapping the first flap, and a closure device for removably engaging the first flap with the second flap;

threading a first shoelace end through a first one of the pair of openings;

threading a second shoelace end through a second one of the pair of openings;

tying the first and second shoelace ends together so that the shoelace knot is disposed in the pouch;

folding the end portions inwardly; and removably engaging the first flap with the second flap to securely contain the shoelace knot in the pouch.

12. The method of claim 11, wherein the closure device comprises hook material attached to the first flap and loop material attached to the second flap.

13. The method of claim 11, wherein the closure device comprises loop material attached to the first flap and hook material attached to the second flap.

14. The method of claim 11, wherein the bottom portion contains hook material outside of the pouch adjacent to the end portions and the shoe contains loop material adjacent to the top portion of the tongue, further comprising, removably attaching the pouch adjacent to the top portion of the tongue of the shoe using the hook and loop materials.

15. The method of claim 11, wherein the bottom portion contains loop material outside of the pouch adjacent to the end portions and the shoe contains hook material adjacent to the top portion of the tongue, further comprising, removably attaching the pouch adjacent to the top portion of the tongue of the shoe using the hook and loop materials.

16. The method of claim 11, wherein the bottom portion of the pouch is fixedly attached adjacent to the top portion of the tongue of the shoe using an attachment mechanism selected from the group consisting of an adhesive, an epoxy, and sewing.

* * * * *